US007042479B2

(12) United States Patent
Furuki et al.

(10) Patent No.: US 7,042,479 B2
(45) Date of Patent: May 9, 2006

(54) IMAGE ENHANCEMENT DEVICE AND IMAGE ENHANCEMENT METHOD OF THERMAL PRINTER

(75) Inventors: Ichiro Furuki, Tokyo (JP); Keiki Yamada, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/037,248

(22) Filed: Jan. 19, 2005

(65) Prior Publication Data

US 2005/0168561 A1 Aug. 4, 2005

(30) Foreign Application Priority Data

Feb. 2, 2004 (JP) ..... 2004-025832

(51) Int. Cl.
*B41J 2/355* (2006.01)

(52) U.S. Cl. ..... 347/183

(58) Field of Classification Search ..... 347/183–185, 347/180–182; 400/120.05, 120.06, 120.07, 400/120.08, 120.09, 120.1, 120.12, 120.13, 400/120.14, 120.15, 120.11
See application file for complete search history.

(56) References Cited

U.S. PATENT DOCUMENTS 5,268,706 A 12/1993 Sakamoto

FOREIGN PATENT DOCUMENTS

JP 59-127781 A 7/1984
JP 61-277465 A 12/1986
JP 02-217268 A 8/1990
JP 04-189552 A 7/1992
JP 05-031939 A 2/1993
JP 2000-071506 A 3/2000
JP 2003-154696 A 5/2003

*Primary Examiner*—K. Feggins
(74) *Attorney, Agent, or Firm*—Birch, Stewart, Kolasch & Birch, LLP

(57) ABSTRACT

The present invention aims to provide an image enhancement device of a thermal printer which can obtain a corrected image with high quality even if quantity of thermal storage to obtain recording density necessary for target gradation data is excessive or insufficient due to thermal history. The image enhancement device of the thermal printer according to the present invention includes: a thermal storage quantity computing unit for computing quantity of thermal storage which affects a heater element of a thermal head using past record; a thermal storage quantity memory unit for storing the quantity of thermal storage computed; a threshold value table having a threshold value which is determined based on input data; a thermal storage quantity discriminating unit for comparing the quantity of thermal storage with the threshold value of the threshold value table; and a correction quantity computing unit for computing correction quantity from the quantity of thermal storage according to comparison result, for obtaining subtraction correction data by subtracting the correction quantity from the input data when the quantity of thermal storage is greater than the threshold value, and for obtaining addition correction data by adding the correction quantity to the input data when the quantity of thermal storage is equal to or less than the threshold value.

14 Claims, 14 Drawing Sheets

IMAGE ENHANCEMENT DEVICE AND IMAGE ENHANCEMENT METHOD OF THERMAL PRINTER

BACKGROUND OF THE INVENTION

1. Field of the Invention

The present invention relates to an image enhancement device and an image enhancement method of a thermal printer, which can obtain a corrected image with high quality even if quantity of thermal storage to acquire recording density necessary for target gradation data is excessive or insufficient due to the thermal history.

2. Background Art

A conventional thermal history correction method of the thermal printer is carried out by discriminating quantity of thermal storage with referring to the temperature of the thermal head detected by a thermistor attached to the thermal head and the number of printing lines and by controlling power distribution quantity to the thermal head (for example, refer to JP 04-189552. pp 2–4, FIG. 1).

Further, another thermal history correction method is proposed, in which the quantity of heat stored in the thermal head is estimated in a value converted to gradation data, and this estimated value is subtracted from printing gradation data for future printing data (for example, refer to JP 2000-71506. pp 2–7, FIG. 1).

The conventional thermal history correction method as disclosed in JP 04-189552 causes irregular printing, since a difference may occur between a temperature of the thermistor and a temperature of the heat stored in the thermal head as the measuring point of the thermistor becomes far from the thermal head, and such difference makes the temperature correction improper. Further, there is a problem that this method costs much because the method needs a temperature detecting means such as the thermistor.

Further, as for the thermal printer, the recording density is low directly after starting printing, and the recording density becomes high as the thermal storage becomes large. In general, the recording density necessary to acquire target gradation data means the recording density at the time when the heat is stored in some degree. That is, it is difficult to obtain target recording density when the thermal storage is small, which causes irregular printing. The thermal history correction method as disclosed in JP 2000-71506 does not need the temperature detecting means, which enables a low-cost implementation. However, this method merely subtracts estimated quantity of thermal storage which is converted to the gradation from original printing gradation data, so that there is a problem that the method can carry out the correction when the heat quantity exceeds the original gradation data but cannot when the quantity of thermal storage is insufficient to obtain the recording density of the original gradation data. Further, there is another problem that the precision for thermal history correction is not high, since the thermal effect of neighboring heater elements in the main scanning direction is not considered for computing the quantity of thermal storage, though the thermal effect in the sub scanning direction is considered.

The present invention is provided to solve the above problems and aims to obtain a corrected image with high quality even if the quantity of thermal storage to acquire recording density necessary for target gradation data is either excessive or insufficient due to the thermal history.

Further, another object of the present invention aims to obtain the corrected image with higher quality by considering the thermal effect not only in the sub scanning direction but also in the main scanning direction.

Yet further, the present invention is to provide a computing method that enables to reduce the processing time for computing correction data.

SUMMARY OF THE INVENTION

According to the present invention, an image enhancement device of a thermal printer includes: a thermal storage quantity computing unit for computing quantity of thermal storage which affects a heater element of a thermal head using past record; a thermal storage quantity memory unit for storing the quantity of thermal storage computed; a threshold value table having a threshold value which is determined based on input data; a thermal storage quantity discriminating unit for comparing the quantity of thermal storage with the threshold value of the threshold value table; a correction quantity computing unit for computing correction quantity from the quantity of thermal storage according to comparison result of the thermal storage discriminating unit, for obtaining subtraction correction data by subtracting the correction quantity from the input data when the quantity of thermal storage is greater than the threshold value, and for obtaining addition correction data by adding the correction quantity to the input data when the quantity of thermal storage is equal to or less than the threshold value.

BRIEF DESCRIPTION OF THE DRAWINGS

A complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Embodiment 1

Figure 1:
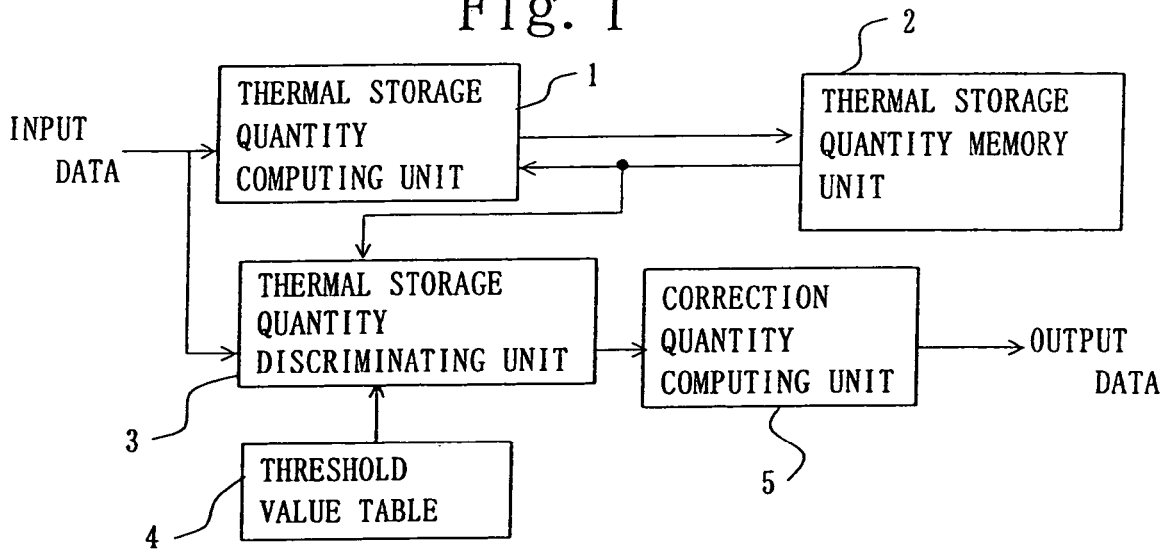
FIG. 1 is a block diagram showing a configuration of an image enhancement device of a thermal printer according to a first embodiment.
Figure 2A:
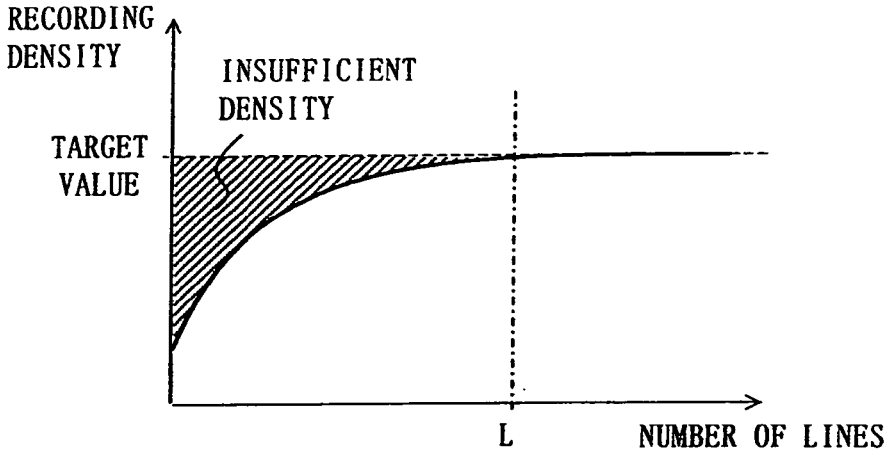
FIGS. 2A and 2B illustrate relationship between thermal storage and recording density for explaining a principle of a thermal storage quantity discriminating unit 3 according to the first embodiment.
Figure 2B:
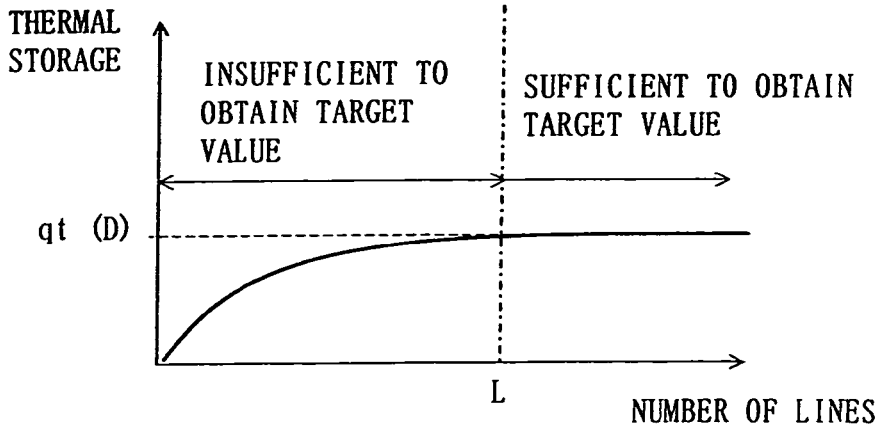
Figure 3:
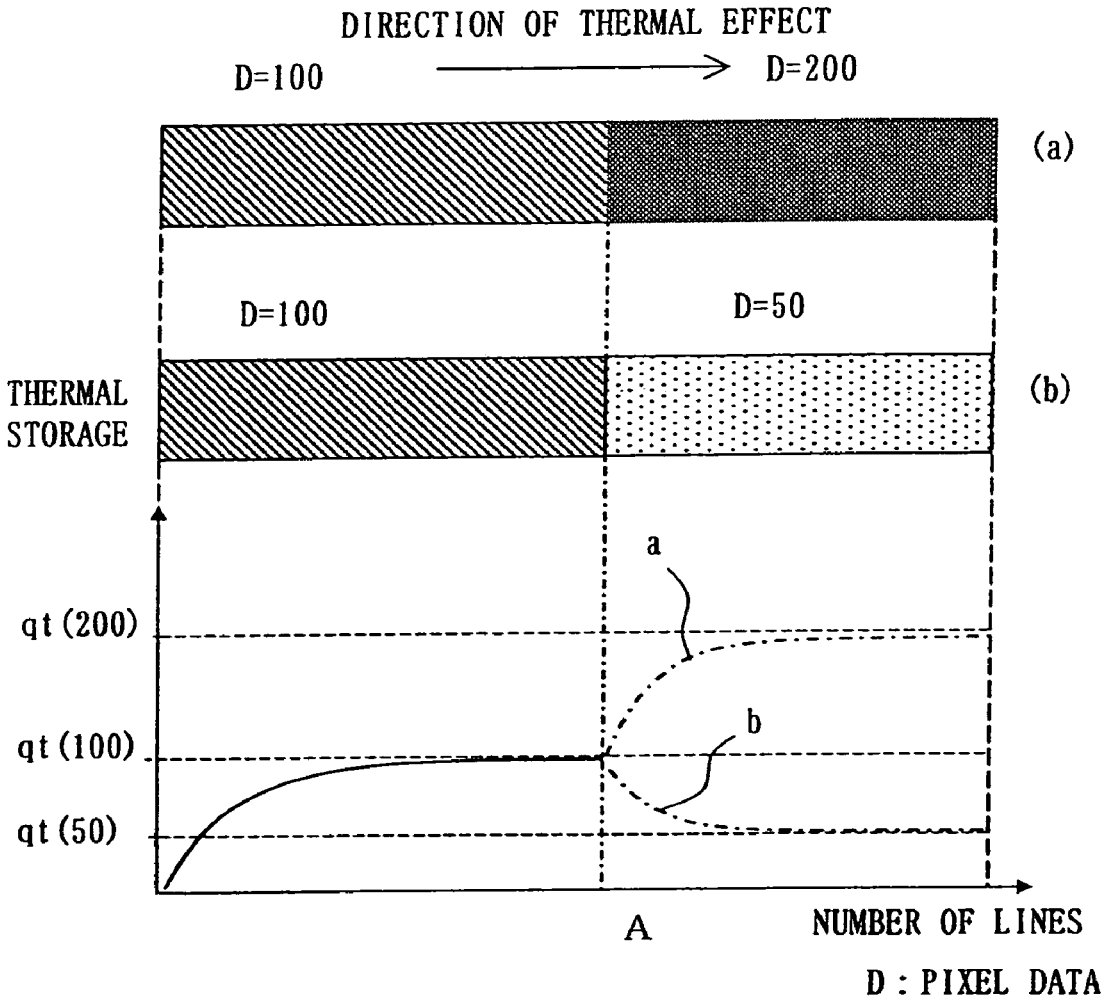
FIG. 3 shows thermal storage status for the number of lines in case of printing solid patterns from 100 gradation levels to (a) 200 gradation levels, and (b) 50 gradation levels according to the first embodiment.
Figure 4:
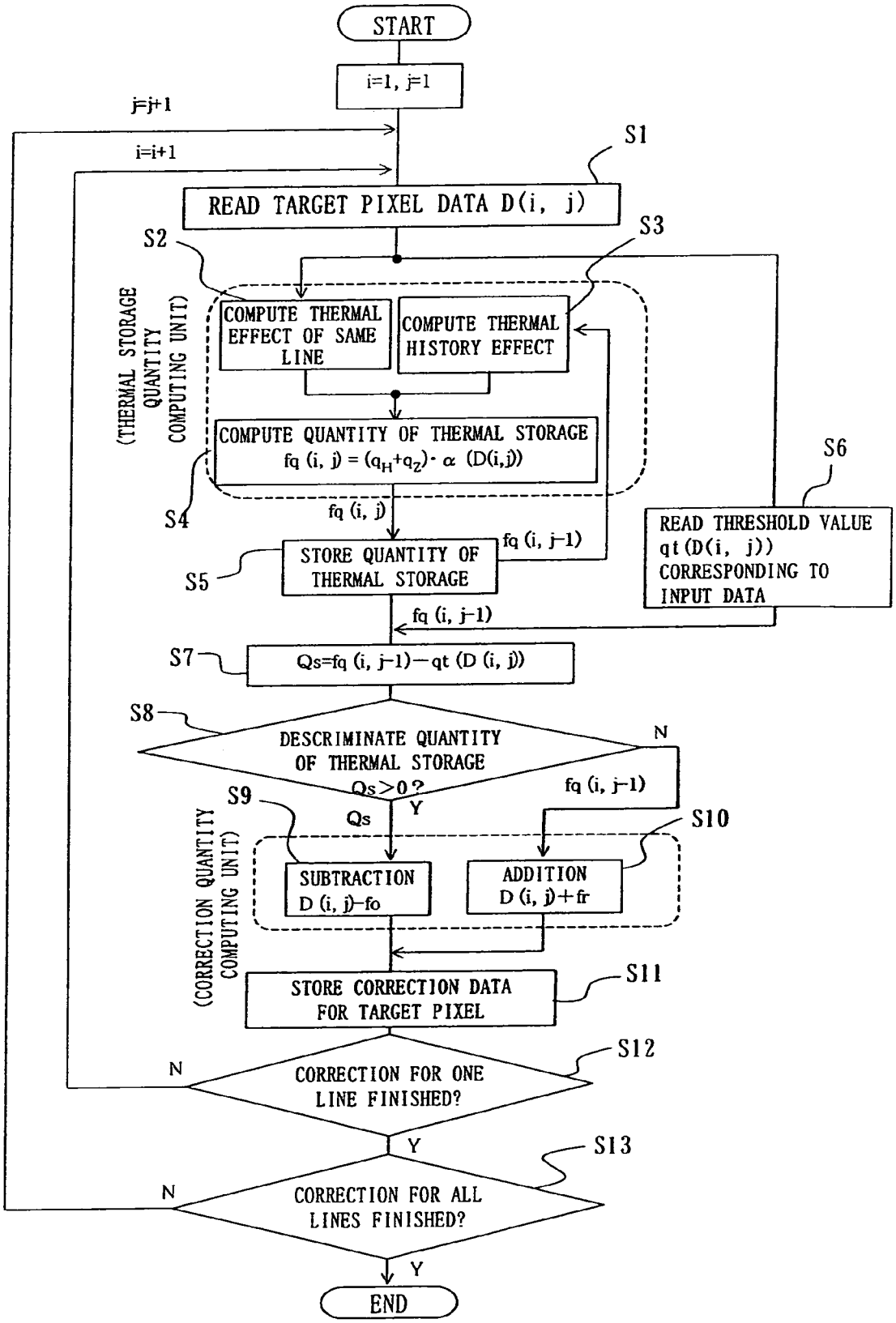
FIG. 4 is a flowchart of computing correction quantity for the image enhancement device of the thermal printer according to the first embodiment.
Figure 5:
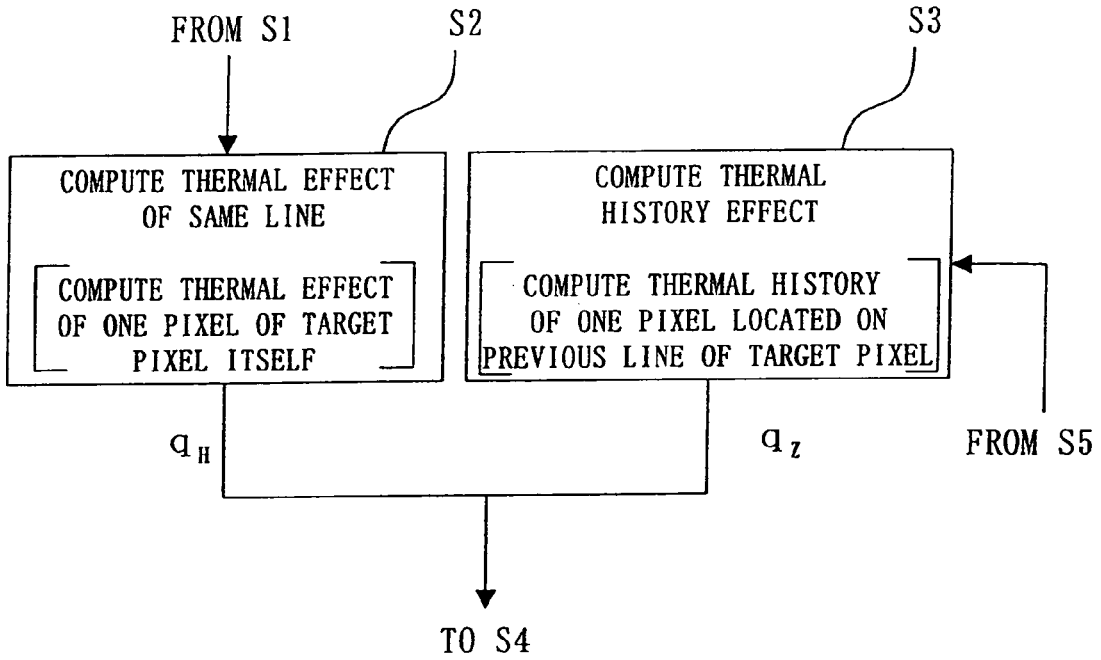
FIG. 5 shows contents of a part of steps of the flowchart of FIG. 4 according to the first embodiment.
Figure 6:
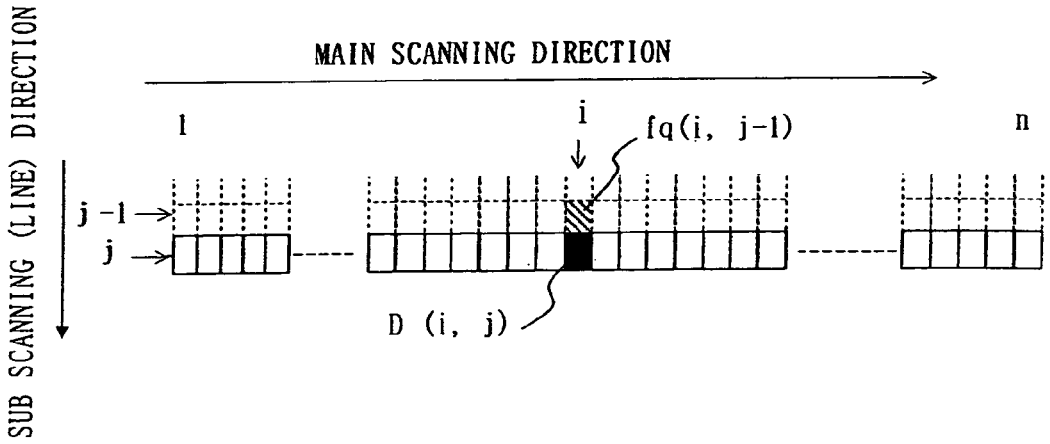
FIG. 6 shows an example of recording display in a sub scanning (line) direction according to the first embodiment.

FIGS. 1 through 6 show the first embodiment of the invention: FIG. 1 is a block diagram showing a configuration of an image enhancement device of a thermal printer; FIGS. 2A and 2B show relationship between thermal storage and recording density for explaining a principle of a thermal storage quantity discriminating unit 3; FIG. 3 shows thermal storage status for the number of lines in case of printing solid patterns from 100 gradation levels to (a) 200 gradation levels and (b) 50 gradation levels; FIG. 4 is a flowchart for computing correction quantity for the image enhancement device of the thermal printer; FIG. 5 shows contents of a part of steps of the flowchart of FIG. 4; and FIG. 6 shows an example of recording display in a sub scanning (line) direction.

The image enhancement device of the thermal printer shown here corrects data output to a thermal head in the thermal printer which carries out printing using the thermal head, not illustrated, constituted by N heater elements.

In FIG. 1, the image enhancement device of the thermal printer includes a thermal storage quantity computing unit 1 for computing thermal effect to a target pixel, a thermal storage quantity memory unit 2 for storing the quantity of thermal storage computed by the thermal storage quantity computing unit 1 by one line, a thermal storage quantity discriminating unit 3 for comparing the quantity of thermal storage of the previous line of the target pixel stored in the thermal storage quantity memory unit 2 and a threshold value corresponding to input data of the target pixel read from a threshold value table 4, and a correction quantity computing unit 5 for carrying out an addition on the input data when thermal history data is equal to or less than the threshold value, and carrying out a subtraction on the input data when the thermal history data exceeds the threshold value.

FIG. 2A is a graph showing relationship between the number of printed lines and recording density in case of printing for the input data D (=gradation data) from the status without thermal history; similarly, FIG. 2B shows another relationship between the number of printed lines and the quantity of thermal storage in case of printing for the input data D. When printing is carried out from the status without thermal storage in the thermal head, the thermal printer has a feature that the recording density directly after starting the printing is low, the recording density increases as the number of lines is increased, and when the number of lines reached a predetermined value, the recording density is saturated as shown in FIG. 2A. This is because, as shown in FIG. 2B, the quantity of thermal storage is low at the beginning of printing, the quantity of thermal storage is increased as the number of printed lines is increased, and when the number of printed lines reaches a predetermined level, the quantity of thermal storage becomes saturated.

Accordingly, it is necessary to have the thermal storage in some degree to obtain enough recording density; in general, a recording density at a line position L when a predetermined lines (time) have passed from the starting time of the printing is often set as a target recording density for the input data D. In the example of FIGS. 2A and 2B, the recording density is insufficient for the target value until the line number reaches L due to the lack of heat, and after the line number reaches Lth line, the quantity of thermal storage becomes sufficient to obtain the target value.

At this stage, the quantity of thermal storage qt(D) sufficient to reach the target density for the input data D is quantified, and this quantity of thermal storage is set as a threshold value. When the quantity of thermal storage of the target pixel is equal to or less than the threshold value, an addition is carried out to the input data D; and when greater than the threshold value, a subtraction is carried out from the input data D.

For example, FIG. 3 shows thermal storage status for the number of lines in case of printing solid patterns from 100 gradation levels to (a) 200 gradation levels and (b) 50 gradation levels. Here, the number of gradation levels is represented by printing system, so that the smaller the value is, the lower the recording density becomes, and the larger the value is, the higher the recording density becomes.

Here, a border line A of the gradation data is observed. In case of (a), the threshold value qt(200) of 200 gradation levels is greater than the quantity of thermal storage qt(100), which is the quantity of thermal storage up to the previous line. This means that the quantity of thermal storage is insufficient for the target recording density of 200 gradation levels, so that an addition is carried out on the input data (200 gradation levels).

In case of (b), the threshold value qt(50) of 50 gradation levels is smaller than the quantity of thermal storage qt(100), which is the quantity of thermal storage up to the previous line. This means that the quantity of thermal storage is excessive for the target recording density of 50 gradation levels, so that a subtraction is carried out on the input data (50 gradation levels).

Next, the correction data computing method will be explained.

FIG. 6 shows an example of recording display in the sub scanning (line) direction. In FIG. 6, i is a position of the target pixel in the main scanning direction, and j shows a line number of the target pixel. Assuming that the maximum number of pixels in the main scanning direction is N, and that the maximum number of lines in the sub scanning direction is M, $1 \leqq i \leqq N$, $1 \leqq j \leqq M$. In FIG. 6, D(i, j) shows data of the target pixel, and fq(i, j−1) shows the quantity of thermal storage at the previous line that affects the target pixel.

In FIG. 4, first at step S1, data D(i, j) of the target pixel is read, computation of thermal effect corresponding to the read pixel data D(i, j) is carried out at step S2. This operation at step S2 obtains quantity of thermal storage $q_H$ which affects the next line due to heat generation of the target pixel itself as shown in FIG. 5. The conversion will be done as follows using a unit thermal storage data Δq(D(i, j)) which is previously determined for each pixel data:

$$q_H=\Delta q(D(i, j)) \quad (1)$$

Next at step S3, thermal effect $q_Z$ of the previous line of the location of the target pixel is obtained as shown in FIG. 5. In case of the first line (j=1), there is no thermal storage, and the thermal effect becomes $q_Z=0$. The second and succeeding lines, the quantity of thermal history effect $q_Z$ will be obtained by the following equation using the quantity of thermal storage fq(i, j−1) of the previous line at the position of the target pixel obtained at step S4.

$$q_Z=fq(i, j-1) \quad (2)$$

Next at step S4, quantity of thermal storage fq(i, j) at the location of the target pixel is obtained. The quantity of thermal storage obtained here shows thermal effect to the next line and the following equation is used:

$$fq(i, j)=(q_H+q_Z)\cdot\alpha(D(i, j)) \quad (3)$$

Here, α(D(i, j)) is a parameter which is inversely proportional to heat radiation time (a time without applying voltage to the thermal head) which is determined based on the data of the target pixel within a recording cycle, and α(D(i, j))<1. The shorter a cooling time within the recording cycle is, namely, the larger the data is (the higher the recording density is), the larger α(D(i, j)) is set to become, and on the contrary, the longer a cooling time within the recording cycle is, namely, the smaller the data is (the lower the recording density is), the smaller α(D(i, j)) is set to become. Usually, the heat radiation characteristics is represented by exponential function; however, since the recording cycle of the recent printer is short as some m sec, the heat radiation characteristics here is approximated linear functionally.

The quantity of thermal storage fq(i, j) obtained at step S4 is stored by one line at step S5, and the computation of the quantity of thermal storage of the target pixel is finished. At steps S3 and S7, the quantity of thermal storage fq(i, j−1) up to the previous line of the target line, of which the quantity of thermal storage is stored by one line, is used.

A detailed computation of correction data will be explained in the following. First at step S6, the threshold value qt(D(i, j)) corresponding to the input data D(i, j) is read. The threshold value qt(D(i, j)) is a constant which is obtained by an experiment and tabulated for each data (gradation) previously. When the quantity of thermal storage is greater than this threshold value, the thermal quantity is excessive for obtaining the target recording density; when the quantity of thermal storage is smaller than this threshold value, the thermal quantity is insufficient.

At step S7, a difference Qs between the quantity of thermal storage fq(i, j−1) up to the previous line of the target pixel and the threshold value qt(D(i, j)) of the target pixel read at step S6 is obtained, and the quantity of thermal storage is discriminated at step S8.

When the difference Qs>0, since the quantity of thermal storage is larger than the threshold value, the thermal quantity is excessive, and the operation proceeds to step S9. When the difference Qs≦0, the operation proceeds to a process of step S10.

Assuming that the correction data is Dout(i, j), and correction quantity when the heat is excessive is $f_0$, the correction data Dout(i, j) is obtained by an equation (4) at step S9.

$$Dout(i, j)=D(i, j)-f_0 \quad (4)$$

$$f_0=Qs \quad (5)$$

In principle, the correction data Dout(i, j) can be obtained by subtracting the quantity of excessive heat Qs from the input data D(i, j); however, practically, since a temperature system (thermal storage or heat radiation) of the printer system is complex, precise correction is difficult by the equation (5). Accordingly, another example of an equation (6) is discussed for obtaining the correction quantity $f_0$.

$$fo=Qs*\mathrm{EXP}[-\tau_0*\Delta t] \quad (6)$$

Here, $\tau_0$ is a heat radiation constant of the printer when the heat quantity is excessive and is obtainable by experiments. Δt is a variable showing a time that has passed since the difference becomes Qs>0, and Δt increases if Qs>0 in the next line. However, Δt is reset (Δt=0) in case of Qs≦0 or when the quantity of thermal storage fq(i, j) exceeds the quantity of thermal storage fq(i, j−1) of the previous line.

Further, after starting the printing, assuming the line number is $j_0$ when the difference becomes Qs>0, when the status Qs>0 is continued up to the jth line, and when Δt of the equation (6) is set to $$\Delta t=j-j_0 \quad (7)$$

the heat radiating time constant $\tau_0$ is determined according to the equation (7). By setting the heat radiating time constant $\tau_0$, it is possible to treat the time variable Δt as the number of lines, which facilitates the correction computation. In this case, Δt=0 when Qs≦0 or when the quantity of thermal storage fq(i, j) exceeds the quantity of thermal storage fq(i, j−1) of the previous line, and Δt=0 until Qs>0.

The input data D(i, j) here means the number of gradation levels; for example, in case of 8-bit data, the range becomes 0≦D(*i, j*)≦255. Accordingly, when Dout(i, j)<0, since the value becomes less than the minimum value, Dout(i, j)=0 is output. However, Dout(i, j)=0 shows no printing status, which sometimes makes the correction data cause excessive correction. To avoid such inconvenience, a correction limitation value Dmin(D(i, j)) can be set corresponding to the input gradation data D(i, j) to output Dout(i, j)=Dmin(D(i, j)) when Dout(i, j)<Dmin(D(i, j)).

In the following, the case of Qs≦0 will be explained. Assuming correction quantity when the heat quantity is insufficient is fr, the correction data Dout(i, j) is obtained by an equation (8) at step S10.

$$Dout(i, j)=D(i, j)+fr \quad (8)$$

$$fr=|Qs| \quad (9)$$

In principle, as shown in the equation (8), the correction data Dout(i, j) can be computed by adding |Qs| (an absolute value of the difference between the quantity of thermal storage and the threshold value) which is the quantity of insufficient heat to the input data D(i, j). However, practically, it is difficult to correct with high precision using the equation (9) because the temperature system (thermal storage or heat radiation) of the printer system is complex. Therefore, an equation (10) is discussed here as another example to compute the correction quantity fr.

$$fr=Th(D(i, j))*\mathrm{EXP}[-\tau_t*fq(i, j-1)] \quad (10)$$

Here, Th(D(i, j)) is a maximum correction constant from the status without thermal history that is determined based on the input data, and $\tau_t$ is a heat storing time constant of the printer when the heat quantity is insufficient. These values can be obtained by experiments. The equation (10) is a function of the quantity of thermal storage fq(i, j−1), so that it is possible to carry out the correction with high precision by following the change of the quantity of thermal storage fq(i, j−1) and adjusting the heat storing time constant of the printer $\tau_t$ and the maximum correction constant Th (D(i, j)).

The input data D(i, j) means the number of gradation levels; for example, in case of 8-bit data, the range of values becomes $0 \leqq D(i, j) \leqq 255$, and the maximum number of gradation levels is 255. Consequently, when Dout(i, j)>the maximum number of gradation levels, Dout(i, j)=the maximum number of gradation levels is output. For example, in case of 8-bit data, the output data becomes Dout(i, j)=255. However, Dout(i, j)=the maximum number of gradation levels shows printing status with the maximum recording density, which sometimes makes the correction data cause excessive correction. To avoid such inconvenience, a correction limitation value Dmax(D(i, j)) can be set corresponding to the input gradation data D(i, j) to output Dout(i, j)=Dmax(D(i, j)) when Dout(i, j)>Dmax(D(i, j)).

The correction data Dout(i, j) obtained at step S9 or step S10 is stored at step S11 as the correction data for the target pixel. At step S12, it is checked if the correction for all pixels of one line is finished; if finished, the operation proceeds to the correction for next line, and if not finished, the correction is carried out on the next pixel of the target pixel. At step S13, it is checked if the correction for all lines is finished; if finished, the correction process terminates.

As discussed above, according to the present embodiment, it is possible to correct the image quality degradation due to excessive or insufficient quantity of thermal storage by comparing the quantity of thermal storage fq(i, j−1) up to the previous line to the target pixel and the threshold value qt(D(i, j) which is determined based on the target pixel data D(i, j), and by discriminating excess or shortage of the heat necessary to record the target pixel data D(i, j).

Further, although in the equation (6) of the above embodiment, the heat radiating time constant of the printer $\tau_0$ is a constant, the heat radiating time constant $\tau$ is obtained by experiments as a variable $\tau_0$(D(i, j)) which is determined based on the input data D(i, j), and it is possible to carry out the correction with higher precision by previously tabulating the obtained variable $\tau_0$(D(i, j)).

Further, when the quantity of thermal storage of the target pixel is insufficient, since the equation for computing the correction quantity is a function of the quantity of thermal storage fq(i, j−1) as shown in the equation (10), it is possible to carry out the correction with higher precision by following the change of the quantity of thermal storage fq(i, j−1) and adjusting the heat storing time constant of the printer $\tau_t$(D(i, j)) and the maximum correction constant Th(D(i, j)).

Further, although in the equation (10) of the above embodiment, the heat storing time constant of the printer $\tau_t$ is a constant, the heat storing time constant of the printer $\tau_t$ is obtained by experiments as a variable $\tau_t$(D(i, j)) which is determined based on the input data D(i, j), and it is possible to carry out the correction with higher precision by previously tabulating the obtained variable $\tau_t$(D(i, j)).

Embodiment 2

A configuration of an image enhancement device of the thermal printer of the present embodiment is almost the same as one of the first embodiment, and the explanation will be focused on a difference.

In the first embodiment, at step S2, the thermal effect of one pixel of the target pixel is computed, and at step S3, the thermal history effect of one pixel of the previous line of the target pixel is computed. In another way, a two dimensional correction can be made by referencing the thermal effect of adjacent pixels, which enables correction with higher precision.

Figure 7:
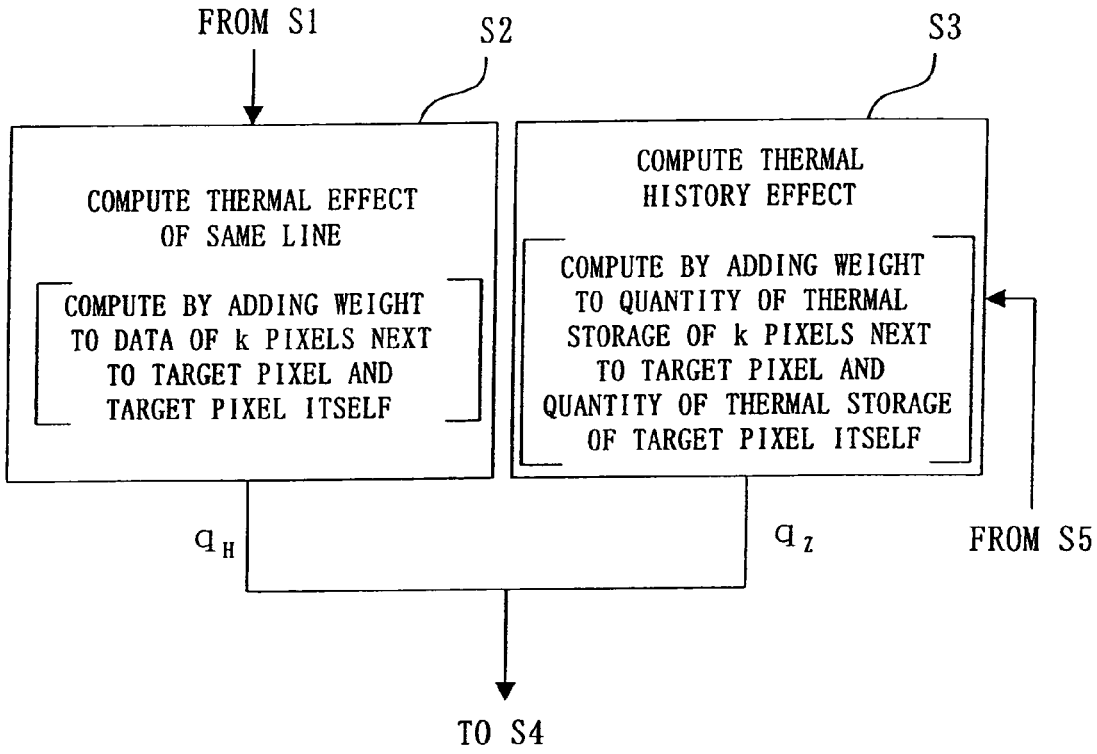
FIG. 7 shows contents of a part of steps in a flowchart of computing correction quantity for the image enhancement device of the thermal printer according to a second embodiment.
Figure 8:
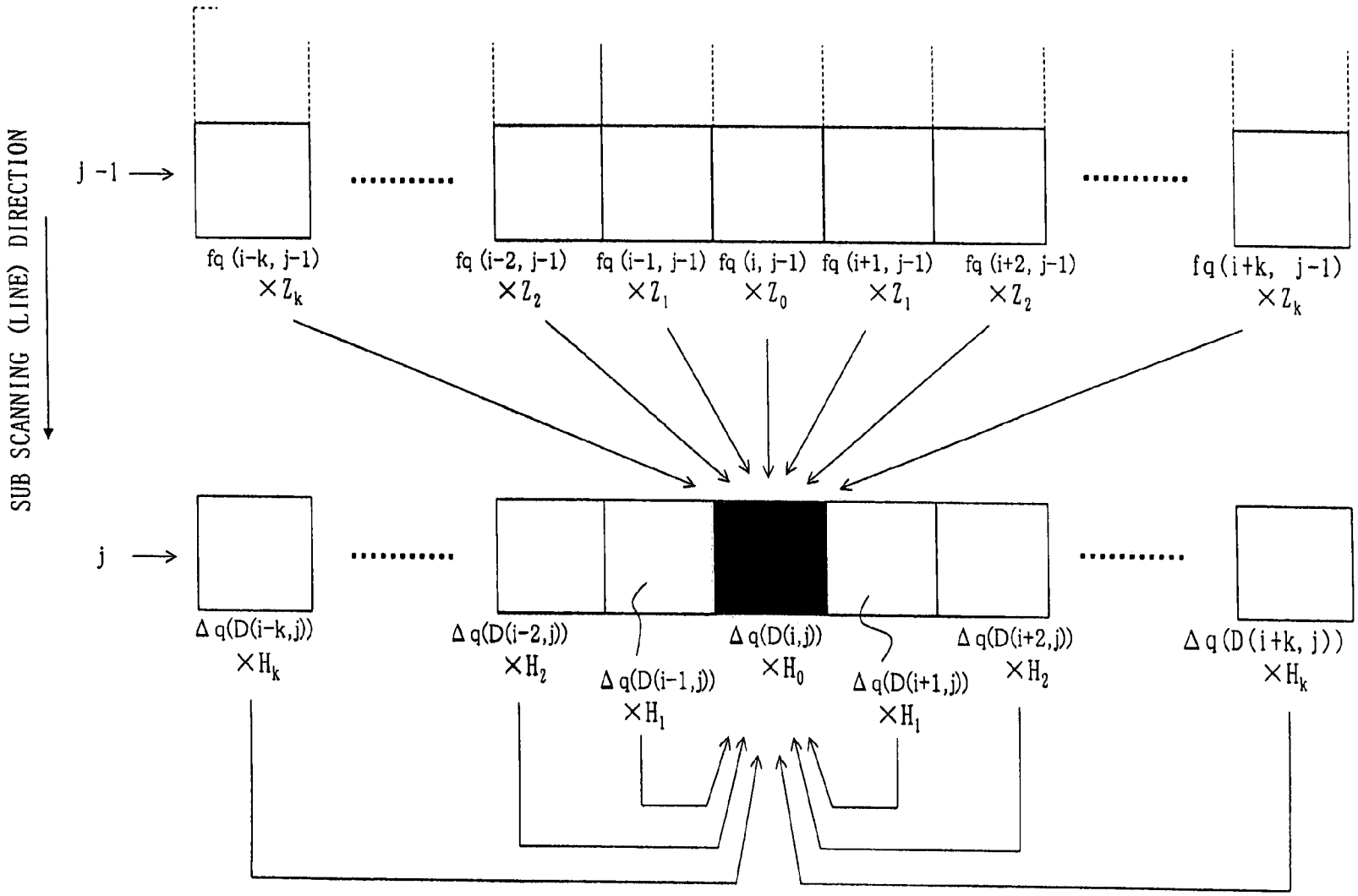
FIG. 8 is a modeling diagram showing a reference method of adjacent thermal effect of the target pixel according to the second embodiment.

FIGS. 7 and 8 show the second embodiment: FIG. 7 shows a part of steps of a flowchart for computing the correction quantity of the image enhancement device of the thermal printer; and FIG. 8 is a modeling diagram that shows a reference method of the adjacent thermal effect of the target pixel.

A processing flow of the second embodiment is basically the same as the one shown in FIG. 4. As shown in FIG. 7, the second embodiment is different in the thermal effect computation for the same line at step S2 and the thermal history effect computation at step S3. Here, the computing method at steps S2 and S3 in the second embodiment will be explained.

In FIG. 8, $Z_x$(x=0, 1, . . . k) is a weight coefficient showing a degree of the thermal effect of the quantity of thermal storage fq(i±x, j−1) to the target pixel, and $H_x$(x=0, 1, . . . k) is a weight coefficient showing a degree of the thermal effect of a neighboring pixel to the target pixel, which respectively satisfy the following:

$$H_0+2*(H_1+H_2+\ldots+H_k)=1 \tag{11}$$

$$Z_0+2*(Z_1+Z_2+\ldots+Z_k)=1 \tag{12}$$

Step S2 shown in FIG. 4 will become as follows according to the present embodiment. The quantity of thermal storage $q_H$ that affects the next line due to the generation of heat of the target pixel itself and the neighboring pixel is obtained by summing up the pixel data D(i±x, j) of k pixels next to the right and the left of the target pixel, each of which weighted by the weight $H_x$, and using an equation (13) (FIG. 7).

$$\begin{aligned} q_H=&\Delta q(D(i,j))\cdot H_0+(\Delta q(D(i+1,j))+\Delta q(D(i-1,j)))\cdot H_1+\\ &(\Delta q(D(i+2,j)+\Delta q(D(i-2,j)))\cdot H_2+\ldots+\\ &(\Delta q(D(i+k,j))+\Delta q(D(-k,j)))\cdot H_k \end{aligned} \tag{13}$$

Further, step S3 shown in FIG. 4 becomes as follows according to the present embodiment. The thermal effect $q_Z$ of the previous line of the location of the target pixel is obtained by summing up the quantity of thermal storage fq(i±x, j−1) of k pixels next to the right and the left of the target pixel, each of which weighted by the weight $Z_x$, and using an equation (14) (FIG. 7).

$$\begin{aligned} q_Z=&fq(i,j-1)\cdot Z_0+(fq(i+1,j-1)+fq(i-1,j-1)\cdot Z_1+(fq(i+\\ &2,j-1)+fq(i-2,j-1))\cdot Z_2+\ldots+(fq(i+k,j-1)+\\ &fq(i-k,j-1))\cdot Z_k \end{aligned} \tag{14}$$

The subsequent operation is the same as the first embodiment, and the explanation will be omitted here. It is preferable to adjust the number of neighboring pixels k and the weight coefficients $H_x$ and $Z_x$ according to the printer system which is an object for correction.

As has been discussed, in this embodiment, the computation of the thermal effect of the same line at step S2 is carried out by adding the weights to the data of k pixels next to the right and the left of the target pixel and to the data of the target pixel itself; and the computation of the thermal history effect at step S3 is carried out by adding the weights to the quantity of thermal storage of neighboring k pixels of the target pixel and to the quantity of thermal storage of the target pixel itself. Consequently, it becomes possible to compute the quantity of thermal storage by considering not only the thermal effect in the sub scanning direction but also the thermal effect of the neighboring pixels of the target pixel, which enables to provide the correction device with higher precision.

Embodiment 3

In the second embodiment, the computation for the correction quantity at and after step S4 in FIG. 4 is carried out using the quantity of thermal storage fq(i, j−1) up to the previous line. Namely, the thermal effect of the neighboring pixels to the target pixel is not considered for computing the correction quantity of the target pixel. This method is applicable to the case in which the neighboring thermal effect to the target pixel is relatively small; however, in case of a printer system in which the neighboring thermal effect is large, it is necessary to consider the neighboring thermal effect to the target pixel for computing the correction quantity of the target pixel. In this embodiment, the neighboring thermal effect to the target pixel is considered at the same time.

Figure 9:
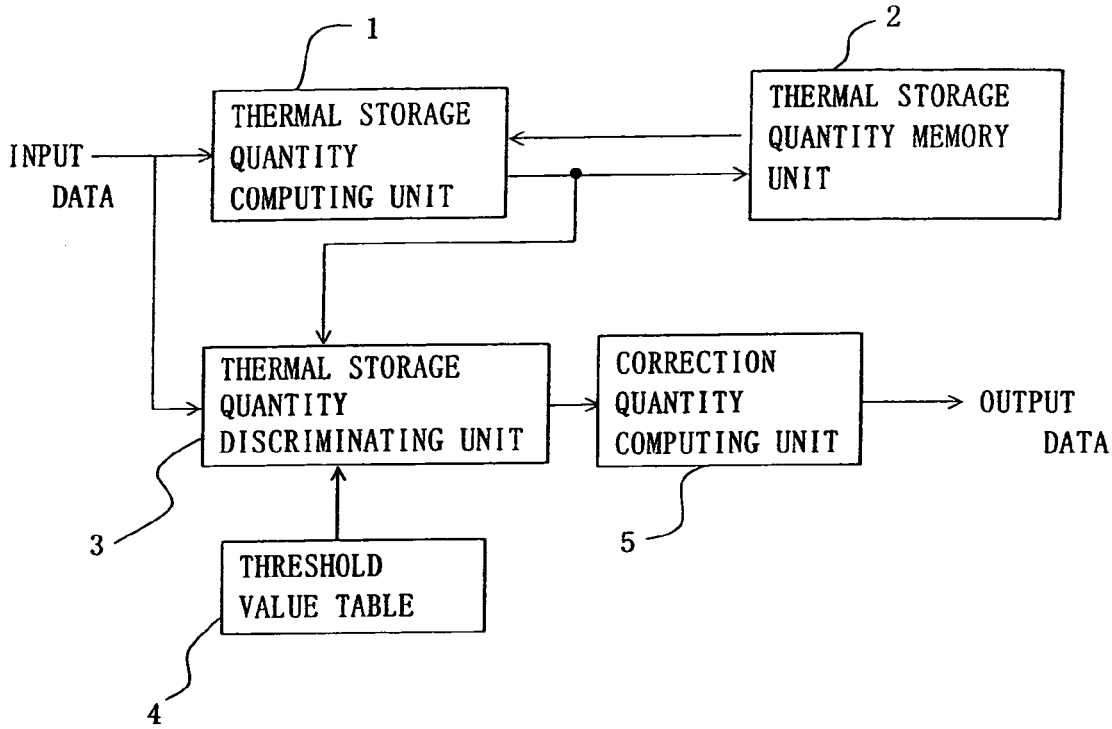
FIG. 9 shows a configuration of an image enhancement device of the thermal printer according to a third embodiment.
Figure 10:
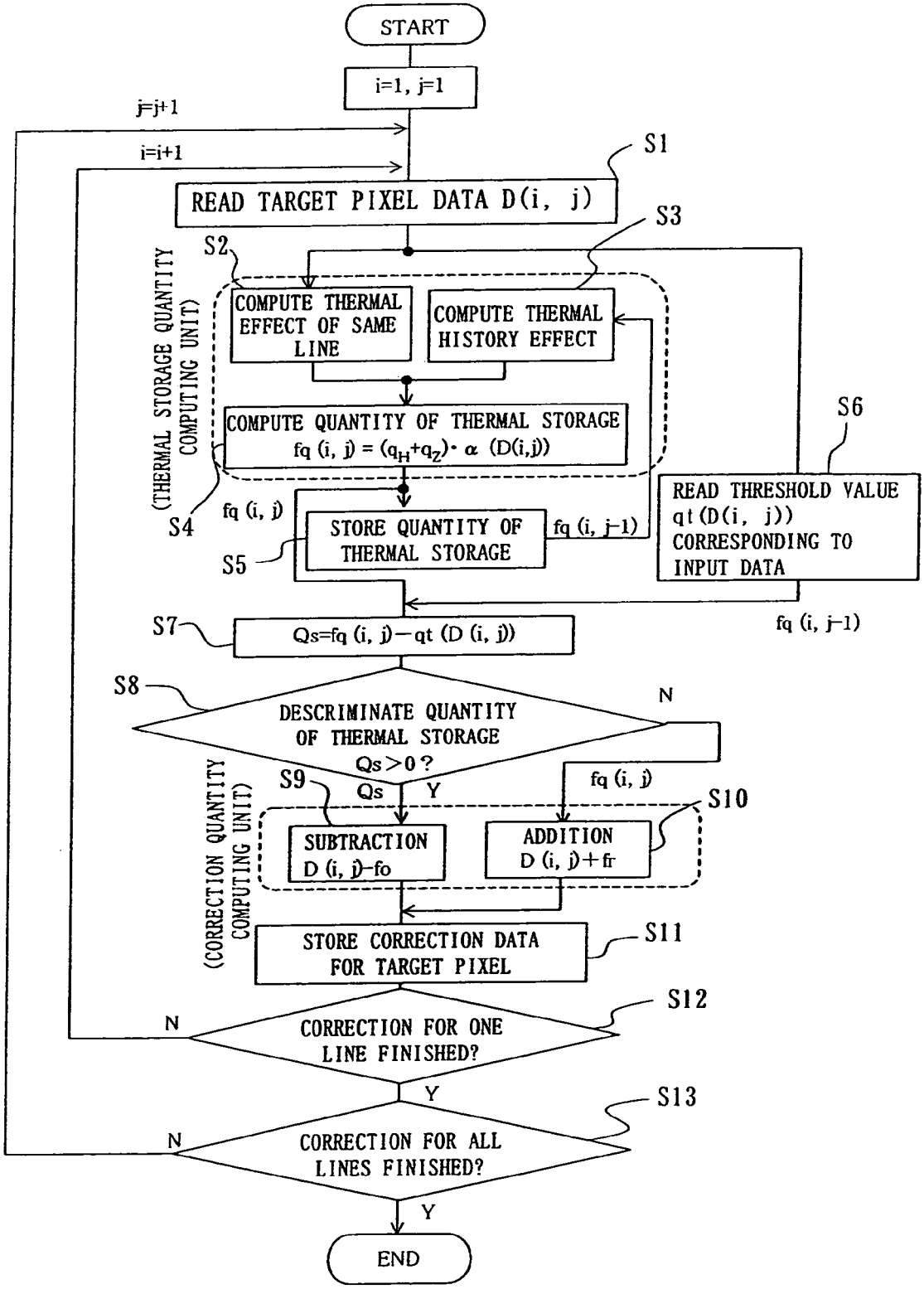
FIG. 10 is a flowchart of computing correction quantity according to the third embodiment.

FIGS. 9 and 10 show the third embodiment. FIG. 9 is a block diagram showing a configuration of an image enhancement device of the thermal printer, and FIG. 10 shows a flowchart of computing the correction quantity. The basic operation is the same as one of the second embodiment, and the explanation is omitted here. The present embodiment is different from the second embodiment in how to process the quantity of thermal storage fq(i, j) at step S4 and subsequent steps.

In this embodiment, the quantity of thermal storage fq(i, j) of the target pixel is used at step S7 without any change. This means that the thermal effect $q_H$ of the same line (neighboring thermal effect to the target pixel) obtained at step S2 is directly reflected as the quantity of thermal storage of the target pixel. In this case, Δq (D(i, j)), $Z_x$(x=0, 1, . . . k), $H_x$(x=0, 1, . . . k) and α(D(i, j)) become different values from the ones in the second embodiment; they are adjusted according to the printer system.

As discussed above, the present embodiment is configured so that the thermal effect of the neighboring pixels to the target pixel when the neighboring pixels are applied at the same time with the target pixel is considered. Accordingly, it is possible to obtain the correction result even if the thermal effect on applying the neighboring pixels at the same time is large in a printer system.

Embodiment 4

A configuration of an image enhancement device of the thermal printer according to the present embodiment is almost the same as the second embodiment, and the explanation here will be focused on different points.

Figure 11:
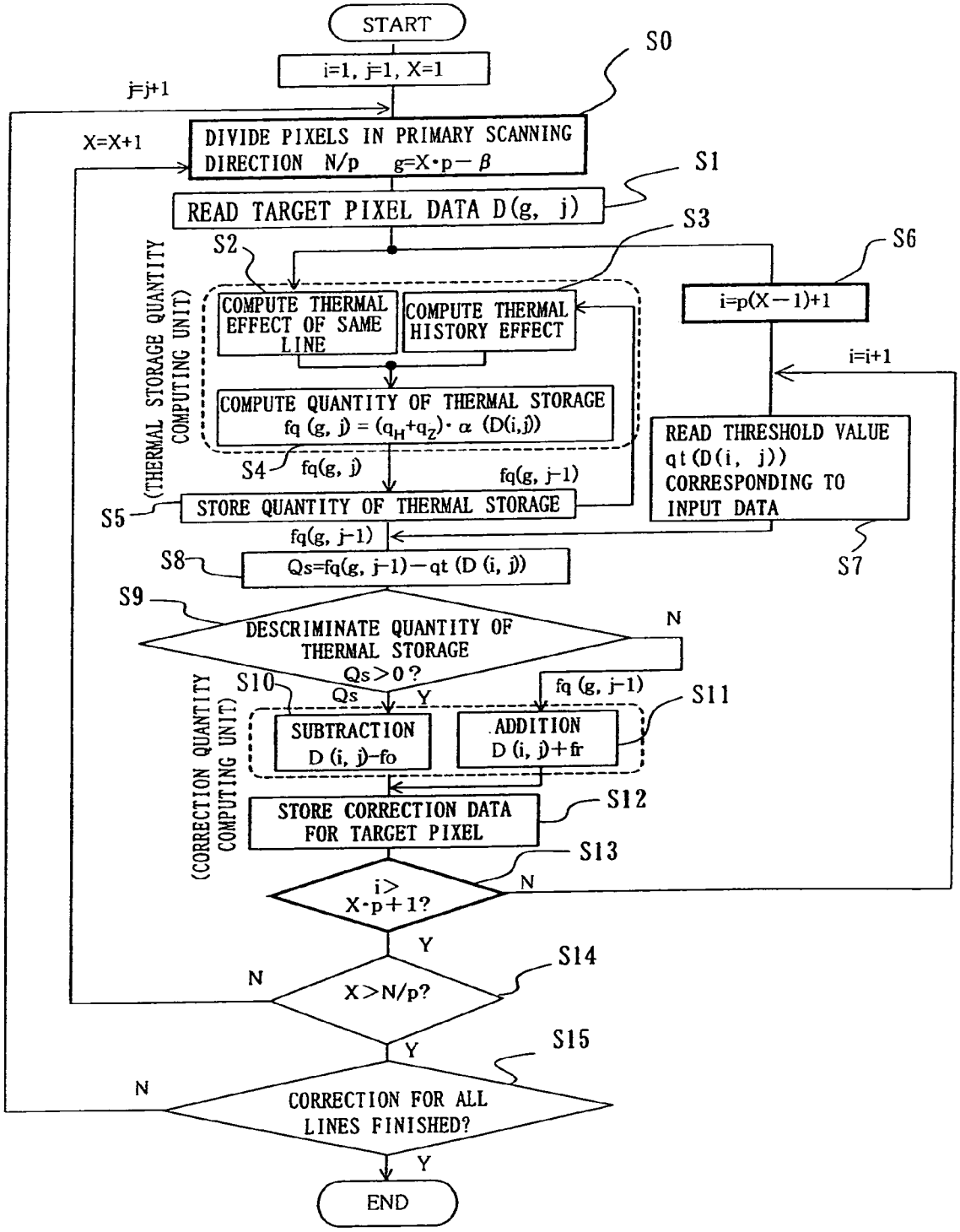
FIG. 11 is a flowchart showing operation procedure according to a fourth embodiment.
Figure 12:
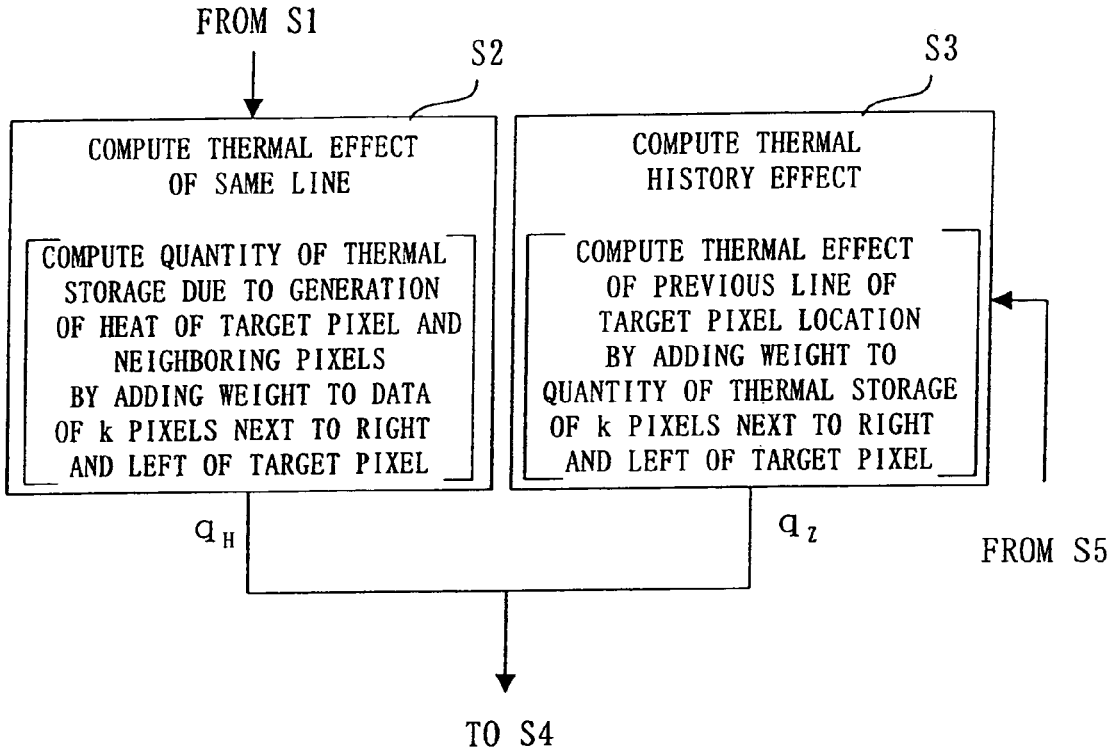
FIG. 12 shows contents of a part of steps in the flowchart of FIG. 11 according to the fourth embodiment.
Figure 13:
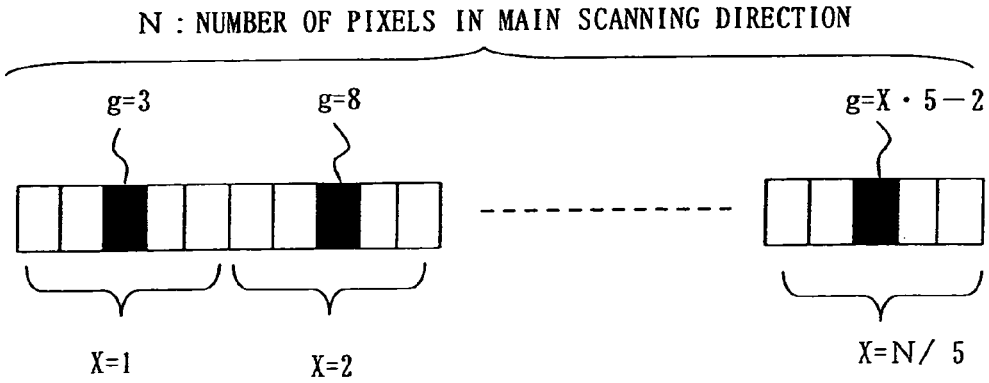
FIG. 13 shows an example of grouping of pixels in a main scanning direction according to the fourth embodiment.
Figure 14:
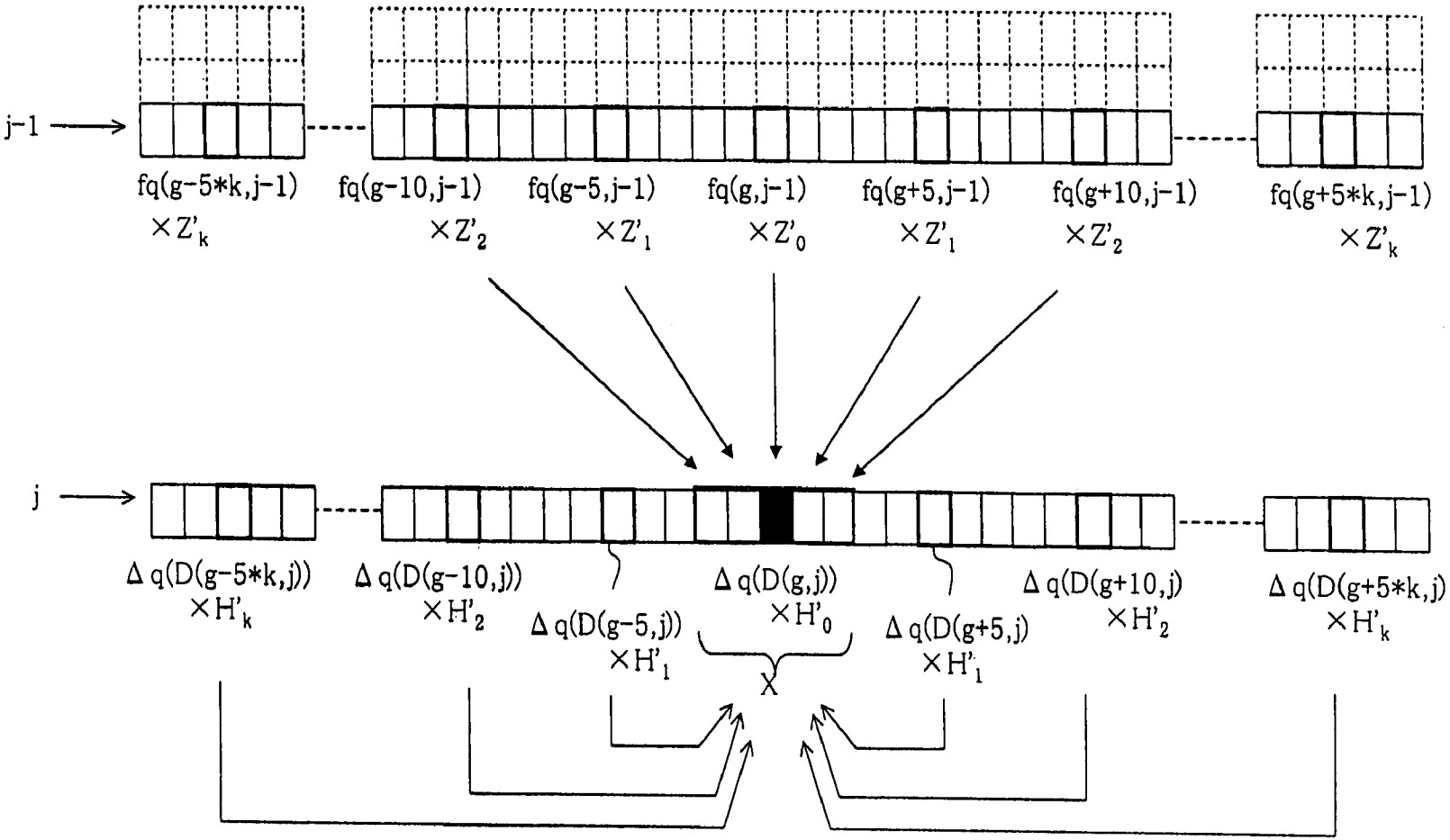
FIG. 14 shows a thermal effect reference model of adjacent pixels according to the fourth embodiment.

FIGS. 11 through 14 show the fourth embodiment. FIG. 11 is a flowchart showing operation procedure; FIG. 12 shows contexts of a part of steps of the flowchart of FIG. 11; FIG. 13 shows an example of grouping pixels in the main scanning direction; and FIG. 14 shows thermal effect reference model of adjacent pixels.

The operation of this embodiment is basically the same as the processing flow of the first and second embodiments; however, the embodiment is different from the first and the second embodiments in that the process (step S0) for dividing the pixels in the main scanning direction is added. When the data to be corrected is image data such as natural drawings, there is little possibility to occur an extreme difference among data of adjacent pixels. The present embodiment will show the correction method effective to the data which has redundancy in some degree in the data in the main scanning direction.

Next, the operation of the present embodiment will be explained. First, at step S0 in FIG. 11, the number of all pixels N in the main scanning direction is divided into groups each having p pixels. Assuming p is a factor of N, the number of pixels in the main scanning direction can be treated as N/p, and when the target group is X, 1≦X≦N/p. An actual pixel location g in the main scanning direction can be expressed by the following equation.

$$g=X\cdot p-\beta \tag{15}$$

β is a constant or a variable for specifying the pixel location within the target group X. For example, FIG. 13 shows an example of grouping pixels in the main scanning direction, in which the grouping is done when the number of all pixels N in the main scanning direction, p=5, and β=2. Here, N is assumed to be a multiple of 5. Hereinafter, the explanation will be based on the example of grouping shown in FIG. 13.

First, at step S0, the pixels in the main scanning direction is divided into groups of N/5 pixels as shown in FIG. 13, and the target pixel is set as a midmost pixel in each group. In the group X, the target pixel location g is computed by the equation (15) as:

$$g=X\cdot 5-2 \tag{16}$$

Next, the target pixel data D(g, j) in the group X is read using the value g represented by the equation (16) (step S1), and the operation proceeds to step S2 for computing the thermal effect of the same line and step S3 for computing the thermal history effect.

FIG. 14 shows a thermal effect reference model of the adjacent pixels at steps S2 and S3. In FIG. 14, a shaded block shows the target pixel, and a white block surrounded by bold line shows a reference pixel. $Z'_x$(x=0, 1, . . . k) is a weight coefficient showing a degree of the thermal effect of quantity of thermal storage fq(g±5*x, j−1) to the target pixel, and $H'_x$(x=0, 1, . . . k) is a weight coefficient showing a degree of the thermal effect of an adjacent location (g±5*x, j) of the target pixel to the target pixel, which respectively satisfy the following equations:

$$H'_0+2^*(H'_1+H'_2+\ldots+H'_k)=1 \tag{17}$$

$$Z'_0+2^*(Z'_1+Z'_2+\ldots+Z'_k)=1 \tag{18}$$

Step S2 shown in FIG. 11 will become as follows according to the present embodiment. The quantity of thermal storage $q_H$ that affects the next line due to the generation of heat of the target pixel itself and the neighboring pixel is obtained by summing up the pixel data D(g±x, j) of k pixels next to the right and the left of the target pixel, each of which weighted by the weight $H'_x$, and using an equation (19) (FIG. 12).

$$\begin{aligned} q_H=&\Delta q(D(g, j))\cdot H'_0+(\Delta q(D(g+5, j))+\\ &\Delta q(D(g-5, j)))\cdot H'_1+(\Delta q(D(g+10, j))+\\ &\Delta q(D(g-10, j)))\cdot H'_2+\ldots+(\Delta q(D(g+5^*k, j))+\\ &\Delta q(D(g-5^*k, j)))\cdot H'_k \end{aligned} \tag{19}$$

Further, step S3 shown in FIG. 11 becomes as follows according to the present embodiment. The thermal effect $q_Z$ of the previous line of the location of the target pixel is obtained by summing up the quantity of thermal storage fq(g±5*x, j) of k pixels next to the right and the left of the target pixel, each of which weighted by the weight $Z_x$, and using an equation (20) (FIG. 12).

$$\begin{aligned} q_Z=&fq(g, j-1)\cdot Z'_0+(fq(g+5, j-1)+fq(g-5, j-1))\cdot Z'_1+\\ &(fq(g+10, j-1)+fq(g-10, j-1))\cdot Z'_2+\ldots+\\ &(fq(g+5^*k, j-1)+fq(g-5^*k, j1))\cdot Z'_k \end{aligned} \tag{20}$$

The subsequent operation up to step S5 is the same as the second embodiment, and the explanation will be omitted here.

A detailed computation for the correction data will be explained in the following. In order to carry out the correction computation for all pixel data within the group X, first, at step S6, the target pixel location i in the group X is represented by the following equation.

$$i=p\cdot(X-1)+1 \tag{21}$$

Next, at step S7, the threshold value qt(D(i, j)) corresponding to the input data D(i, j) is read using the above i. The threshold value qt(D(i, j)) is a constant which is obtained by experiments and tabulated previously for each data (gradation). When the quantity of thermal storage is greater than this threshold value, the heat quantity is excessive for obtaining the target recording density; when the quantity of thermal storage is smaller than the threshold value, the heat quantity is insufficient.

At step S8, a difference Qs between the quantity of thermal storage fq(g, j−1) up to the previous line of the target pixel and the threshold value qt(D(i, j)) of the target pixel read at step S7 is obtained, and the quantity of thermal storage is discriminated at step S9.

The subsequent operation at steps S10 through S12 is the same as the first embodiment, and the explanation will be omitted here.

Next, at step S13, it is checked if the correction for all pixels of the group X is finished; if not finished, the correction is carried out on the next pixel by changing i=i+1 within the group X. If the correction of all pixels in the group X is finished, at step S14, it is checked if the correction for all groups of one line is finished. If finished, the operation proceeds to the correction for the next line, and if not finished, the correction of the next group of the target group.

At step S15, it is checked if the correction of all lines is finished, and if finished, the correction process terminates. In the above embodiment, the quantity of thermal storage is computed once in each group, and the computation of the final correction quantity is carried out using the result of the quantity of thermal storage computation. Consequently, the number of computations in the main scanning direction is reduced to N/p, which enables to shorten the time required for computing the quantity of thermal storage. Here, the number of neighboring reference pixels k, the weight coefficients $H'_x$ and $Z'_x$ are adjusted according to the system of the printer which is an object for correction.

As discussed above, according to the present embodiment, it is possible to shorten the computation time of the quantity of thermal storage by dividing the number of all pixels N in the main scanning direction into groups each having p pixels, and by reducing the number of computations in the main scanning direction to N/p. The more the data in the main scanning direction has redundancy, the more the effect of this embodiment increases.

As well as the third embodiment, the quantity of thermal storage fq(g, j) at and after step S4 is also used at step S8 without any change. This means that the thermal effect $q_H$ of the same line (neighboring thermal effect to the target pixel) obtained at step S2 is directly reflected as the quantity of thermal storage of the target pixel. Consequently, it is possible to obtain good correction result even if the printer system in which the thermal effect when the neighboring pixels are applied at the same time becomes large is used. In this case, Δq(D(i, j)), $Z'_x$, $H'_x$ and α(D(i, j)) at steps S2 and S3 become different values from the ones in the fourth embodiment; they are adjusted according to the printer system.

Embodiment 5

A configuration of an image enhancement device of the thermal printer according to the present embodiment is almost the same as the fourth embodiment, and the explanation here will be focused on different points.

Figure 15:
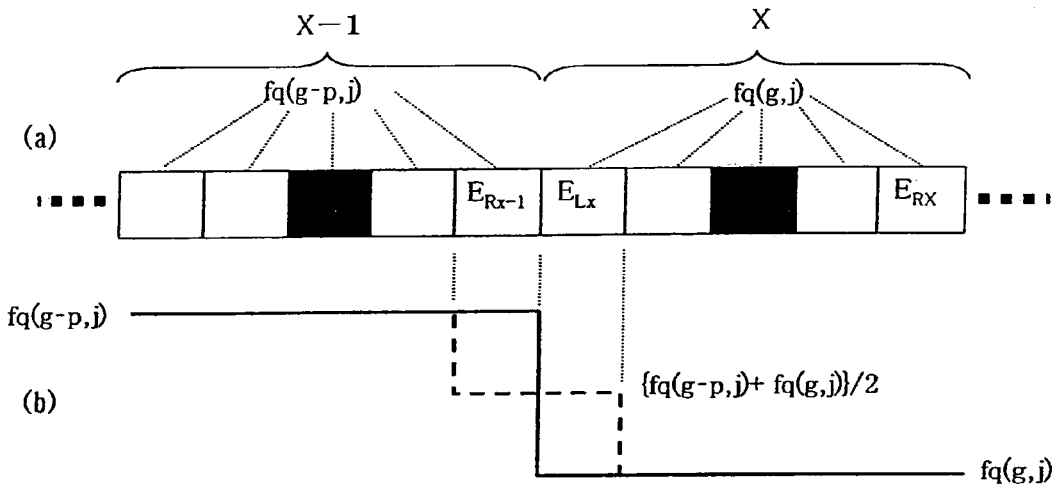
FIG. 15 shows thermal storage quantities of pixels in a group X and a group (X−1) according to a fifth embodiment.

FIG. 15 shows the fifth embodiment, illustrating the quantity of thermal storage of the pixels within the group X and the group (X−1). In FIG. 15, (a) shows the quantity of thermal storage of each pixel of the group X and the group (X−1), (b) illustrates the above quantity of thermal storage by a graph, in which a vertical direction shows a degree of the quantity of thermal storage, and a horizontal direction shows a pixel location in the main scanning direction. In this case, the quantity of thermal storage fq(g, j) of the group X<the quantity of thermal storage fq(g−p, j) of the group (X−1).

It is assumed that bordering pixels of the group X and the group (X−1) are $E_{LX}$ and $E_{RX-1}$, respectively. When fq(g, j)< fq(g−p, j), since the fourth embodiment assumes that the quantity of thermal storage within each group is the same, the computed result creates a difference between the thermal storage quantities $E_{LX}$ and $E_{RX-1}$ as illustrated by a solid line as (b) in FIG. 15. This difference is apparent when the difference between fq(g, j)<fq(g−p, j) is large, which may cause unnecessary stripes or uneven density on the corrected image quality. Therefore, it is desired that the difference between the thermal storage quantities of the bordering pixels of the group (X−1) and the group X should be small.

In this embodiment, it will be explained how to reduce the difference of the quantities of thermal storage between the bordering pixels of groups.

The operation is basically the same as the fourth embodiment shown in FIG. 11. The processes at steps S5 and S8 will be discussed here, in which the operation differs from the fourth embodiment.

First, at step S5, the quantity of thermal storage fq(g, j) in the group X is stored. At this time, the quantity of thermal storage fq(g−β+1, j) of the bordering pixel $E_{LX}$ of the group X and the quantity of thermal storage fq(g−β, j) of the bordering pixel $E_{RX-1}$ of the group (X−1) are computed using an equation (22) and then stored.

$$fq(g-\beta+1, j)=fq(g-\beta, j)=\{fq(g, j)+fq(g-p, j)\}/2 \tag{22}$$

With this operation, the quantity of thermal storage fq(g−β+1, j) of the bordering pixel $E_{RX}$ of the group X and the quantity of thermal storage fq(g−β, j) of the bordering pixel $E_{RX-1}$ of the group (X−1) are respectively stored as mean values of the thermal storage quantities of neighboring groups. The difference of quantities of thermal storage between the bordering pixels of the group X and the group (X−1) is reduced to ½ as shown by a broken line in (b) of FIG. 15.

Next, at step S8, the difference Qs between the quantity of thermal storage fq(g, j−1) up to the previous line of the target pixel and the threshold value qt(D(i, j)) of the target pixel read at step S7 is obtained. At this time, when the pixel location i becomes the end of the target group after X≧2, the difference Qs can be obtained using the quantity of thermal storage up to the previous line computed by the equation (22).

As has been discussed, the quantity of thermal storage of the bordering pixels of the neighboring groups is obtained as the mean value of the quantity of thermal storage of the neighboring groups, which enables to reduce the difference of the quantities of thermal storage of the border between groups. Accordingly, it is possible to reduce the degradation of the quality of the corrected image such as unnecessary stripes or uneven density.

Embodiment 6

A configuration of an image enhancement device of the thermal printer according to the present embodiment is almost the same as the fourth embodiment, and the explanation here will be focused on different points.

Figure 16:
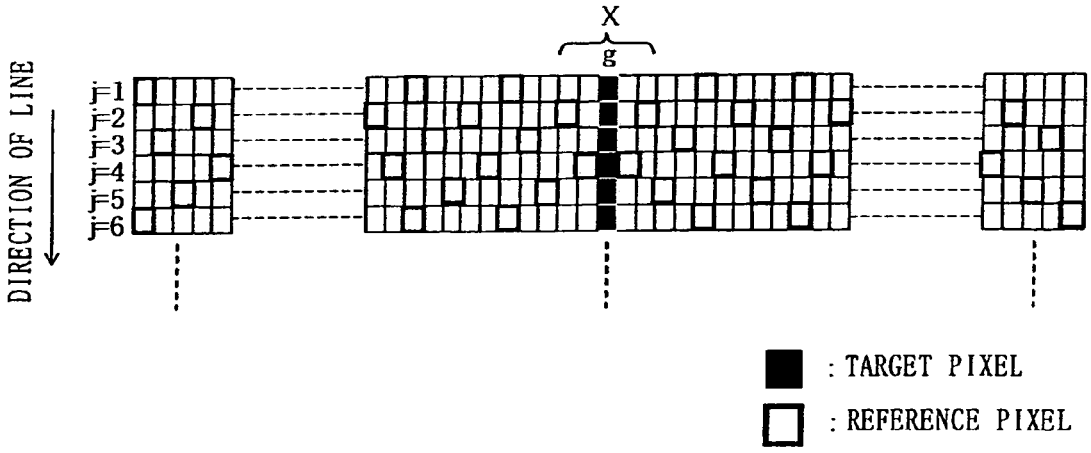
FIG. 16 shows locations of thermal effect reference pixels adjacent to a target pixel for each line according to according to a sixth embodiment.

FIG. 16 shows an example of locations of thermal effect reference pixels adjacent to the target pixel of each line. In FIG. 16, a shaded block shows the target pixel, and a white block surrounded by a bold line shows a reference pixel. As shown in FIG. 16, according to the present embodiment, on referencing the thermal effect of the pixels adjacent to the target pixel at steps S2 and S3 of FIG. 11 in the fourth embodiment, the location of the reference pixel is changed at random for each line.

As has been discussed, the present embodiment is configured so that the location of the reference pixel within each group divided for each line is changed at random, which enables to reduce the error in the computation of the correction quantity due to the dislocation of the pixel data.

Further, similarly, it is also possible to reduce an error in computation of the correction quantity due to dislocation of the pixel data by setting β of the equation (15) as a variable and changing the location of the target pixel at random for each line.

Embodiment 7

A configuration of an image enhancement device of the thermal printer according to the present embodiment is almost the same as the fourth embodiment, and the explanation here will be focused on different points.

Figure 17:
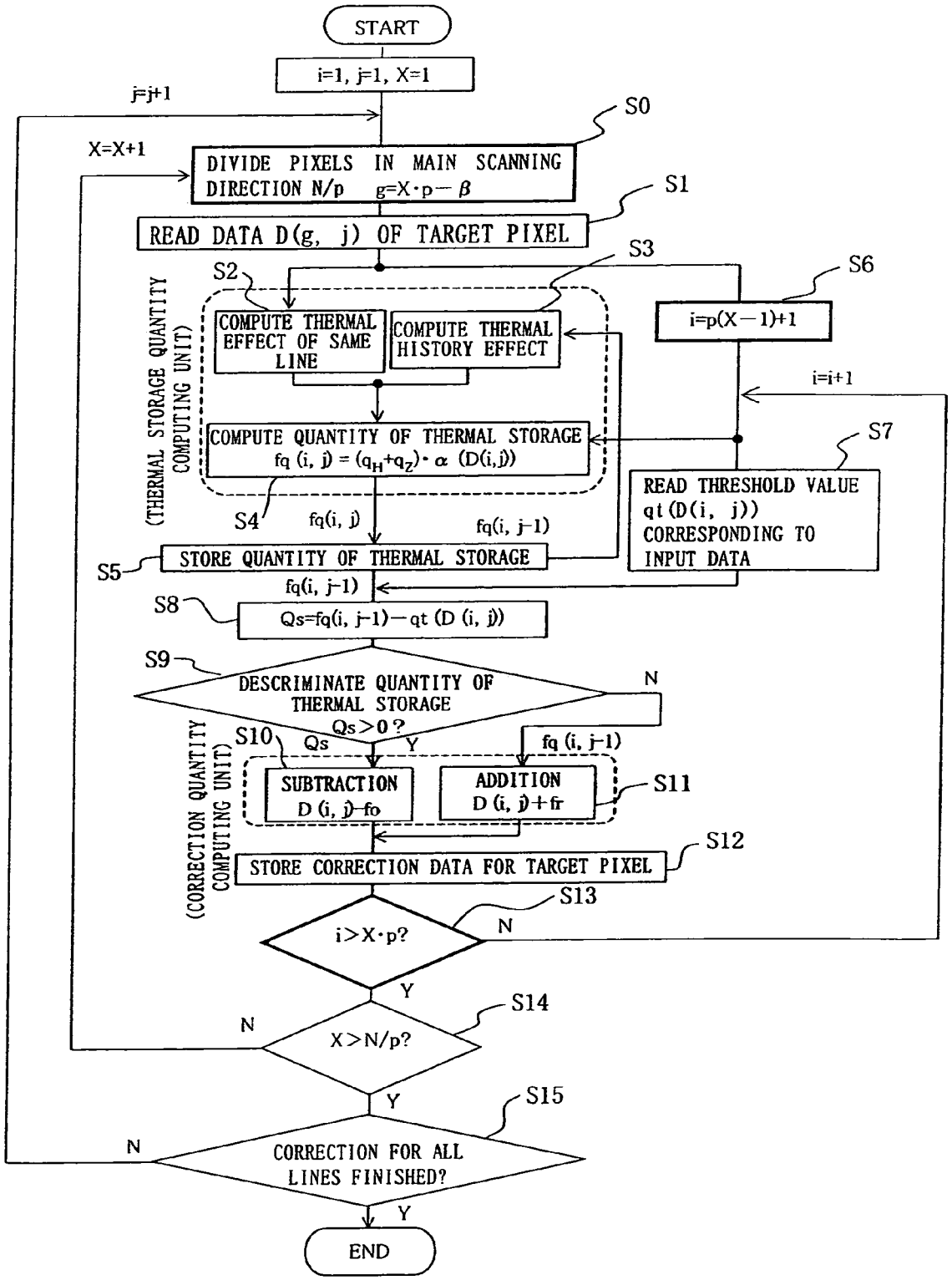
FIG. 17 is a flowchart showing operation procedure according to a seventh embodiment.
Figure 18:
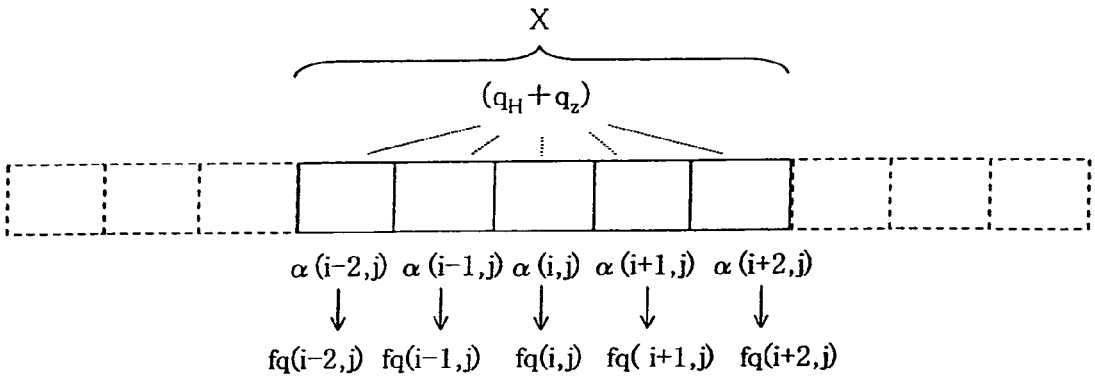
FIG. 18 shows a modeling diagram for computing quantity of thermal storage when the number of element of group p=5 according to the seventh embodiment.

FIGS. 17 and 18 show the seventh embodiment. FIG. 17 is a flowchart showing operation procedure, and FIG. 18 shows a computation model for the quantity of thermal storage when the number of elements p in a group=5. In the fourth embodiment, it is assumed that the quantity of thermal storage within the group X is the same, and according to the present embodiment, the quantity of thermal storage of each pixel within each group is computed independently.

The operation of the present embodiment will be explained in the following. In FIG. 17, the operation from step S0 through step S3 is the same as the fourth embodiment, and the explanation is omitted here. In each pixel within the group X, the thermal effect $q_H$ of the same line obtained at step S2 and the thermal history effect $q_Z$ obtained at step S3 become the same values. Next, at step S4, as shown in FIG. 4, the quantity of thermal storage fq(i j) is obtained independently for all pixels within the group X using the coefficient α(D(i, j)) corresponding to the pixel data in the group X. The operation thereafter is the same as the third embodiment, and the explanation will be omitted here.

As described above, according to the present embodiment, in the group X, the thermal effect $q_H$ and the thermal history effect $q_Z$ are obtained by applying the value obtained by referring to an arbitrary pixel in the group X to all pixels in the group X and computing the quantity of thermal storage fq(i, j) for all pixels in the group X using the coefficient α(D(i, j)) corresponding to the pixel data in the group X. Consequently, it is possible to shorten the processing time by reducing the number of computations of the thermal effect and to improve the correction precision.

Embodiment 8

Figure 19:
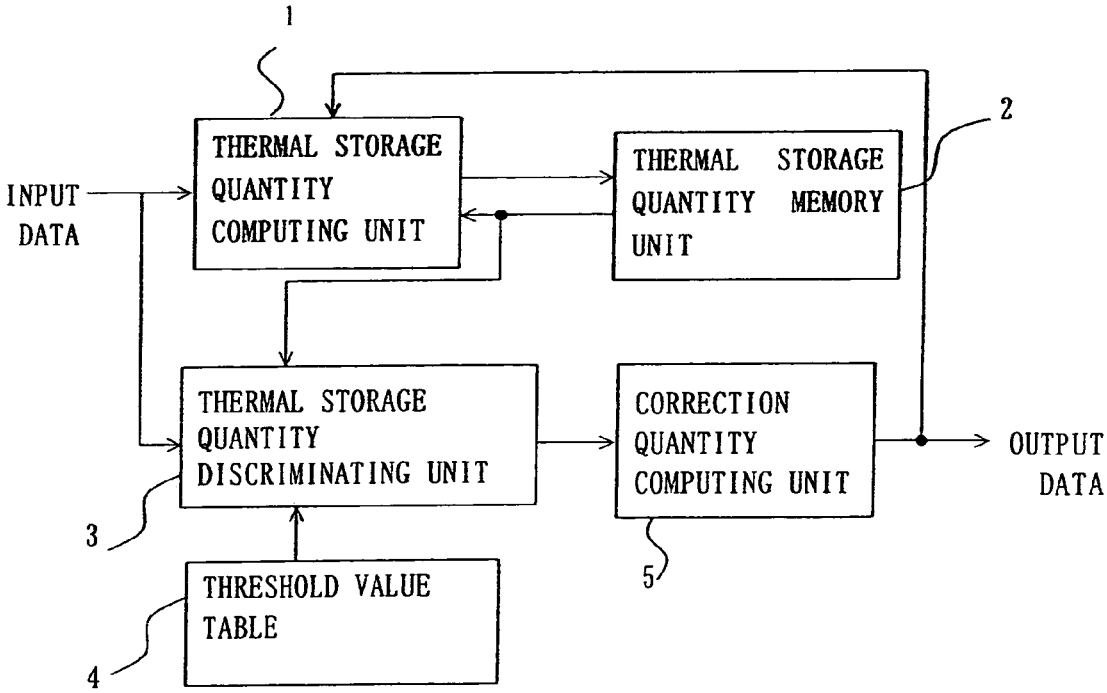
FIG. 19 is a block diagram showing a configuration of an image enhancement device of the thermal printer according to an eighth embodiment.

FIG. 19 shows the eighth embodiment and is a block diagram showing a configuration of an image enhancement device of the thermal printer. According to the foregoing first through seventh embodiments, the quantity of thermal storage is computed based on the input data. In this embodiment, it is possible to obtain the correction result with higher precision with considering the thermal storage of the corrected data by feeding back the data of the computed correction quantity to the thermal storage quantity computing unit 1 as shown in FIG. 19 and by computing the quantity of thermal storage which affects the next line.

According to the present invention, the image enhancement device of the thermal printer can obtain corrected image with high quality even if the quantity of thermal storage to obtain the recording density necessary to the desired gradation data is excessive or insufficient due to the thermal history.

Having thus described several particular embodiments of the present invention, various alterations, modifications, and improvements will readily occur to those skilled in the art. Such alterations, modifications, and improvements are intended to be part of this disclosure, and are intended to be within the spirit and scope of the present invention. Accordingly, the foregoing description is by way of example only, and is not intended to be limiting. The present invention is limited only as defined in the following claims and the equivalents thereto.

What is claimed is:

1. An image enhancement device of a thermal printer comprising:

a thermal storage quantity computing unit for computing quantity of thermal storage which affects a heater element of a thermal head using past recorded thermal storage data;

a thermal storage quantity memory unit for storing the quantity of thermal storage computed;

a threshold value table having a threshold value which is determined based on input data;

a thermal storage quantity discriminating unit for comparing the quantity of thermal storage with the threshold value of the threshold value table; and a correction quantity computing unit for computing correction data from the quantity of thermal storage according to comparison result of the thermal storage quantity discriminating unit, for obtaining subtraction correction data by subtracting a correction quantity from the input data when the quantity of thermal storage is greater than the threshold value, and for obtaining addition correction data by adding the correction quantity to the input data when the quantity of thermal storage is equal to or less than the threshold value.

2. The image enhancement device of the thermal printer of claim 1, wherein the thermal storage quantity computing unit comprising:

a same line thermal effect computing unit for computing thermal effect of a target pixel and neighboring pixels located next to right and left of the target pixel in a same printing line; and a thermal history effect computing unit for computing thermal effect of the target pixel and the neighboring pixels in a previous line.

3. The image enhancement device of the thermal printer of claim 2, wherein the correction quantity computing unit computes the correction quantity of the target pixel with considering thermal effect of the neighboring pixels of the target pixel to the target pixel when the neighboring pixels are applied at same time with the target pixel.

4. The image enhancement device of the thermal printer of claim 2, wherein the thermal storage quantity computing unit is configured so that on referencing thermal effect of surrounding of the target pixel, a pixel location for referencing is changed at random for each line.

5. The image enhancement device of the thermal printer of claim 1, wherein the thermal storage quantity computing unit comprising a main scanning direction pixels grouping unit for dividing image data in a main scanning direction corresponding to a plurality of heater elements aligned on the thermal head into groups each having p pieces of the image data.

6. The image enhancement device of the thermal printer of claim 5, wherein the image enhancement device computes quantity of thermal storage for an arbitrary pixel of each group of the groups divided by the main scanning direction pixels grouping unit and assigns the quantity of thermal storage computed for the arbitrary pixel of each group to other remaining pixels in the each group which the arbitrary pixel belongs to.

7. The image enhancement device of the thermal printer of claim 6, wherein the image enhancement device uses a mean value of quantity of thermal storage of the arbitrary pixel of each group as the quantity of thermal storage of bordering pixels of neighboring groups in the groups divided by the main scanning direction pixels grouping unit.

8. The image enhancement device of the thermal printer of claim 5, wherein the image enhancement device computes the quantity of thermal storage individually for each pixel of each group of the groups divided by the main scanning direction pixels grouping unit.

9. The image enhancement device of the thermal printer of claim 1, wherein the image enhancement device computes the quantity of thermal storage by feeding back one of the subtraction correction data and the addition correction data computed by the correction quantity computing unit to the thermal storage quantity computing unit.

10. The image enhancement device of the thermal printer of claim 1, wherein when the quantity of thermal storage is equal to or less than the threshold value, the correction quantity is obtained by a following equation, in which a pixel location in a main scanning direction corresponding to a heater element of the thermal head is i; correction quantity directly before starting printing a target pixel of jth line is fr; a heat storing time constant of a printer system when heat is insufficient is $\tau_t$; quantity of thermal storage of the target pixel up to (j−1)th line is fq(i, j−1); input data of the target pixel of the jth line is (D(i, j); and a correction constant which is determined based on the input data of the target pixel is Th (D(i, j)):

$$fr=Th(D(i, j))*\mathrm{EXP}\ [-\tau_t*fq(i, j-1)].$$

11. The image enhancement device of the thermal printer of claim 10, wherein the heat storing time constant $\tau_t$ is set to a constant $\tau_t$(D(i, j)) which is determined based on the input data (D(i, j)) of the target pixel.

12. The image enhancement device of the thermal printer of claim 1, wherein when the quantity of thermal storage is greater than the threshold value, the correction quantity is obtained by a following equation, in which the quantity of thermal storage of the target pixel and the threshold value corresponding to the input data of the target pixel are respectively converted to gradation data, a difference between the quantity of thermal storage and the threshold value which are converted to the gradation data is Qs, correction quantity (correction data) directly before starting printing the target pixel of jth line is $f_0$, a heat radiating time constant of a printer system when heat is excessive is $\tau_0$, a number of lines when the difference between the quantity of thermal storage and the threshold value is Qs>0 is $j_0$, and a number of lines when the difference continues Qs>0 up to the jth line is $\Delta t=j-j_0$:

$$f_0=Qs * \mathrm{EXP}\ [-\tau_0 * \Delta_t].$$

13. The image enhancement device of the thermal printer of claim 12, wherein the heat radiating time constant $\tau_0$ is set to a constant $\tau_0$(D(i, j)) which is determined based on the input data D(i, j) of the target pixel.

14. A method for image enhancing of a thermal printer comprising:

computing quantity of thermal storage which affects a heater element of a thermal head using past record of thermal data;

storing the quantity of thermal storage computed;

comparing the quantity of thermal storage with a threshold value of a threshold value table which is determined based on input data; and computing correction quantity from the quantity of thermal storage according to comparison result, for obtaining subtraction correction data by subtracting the correction quantity from the input data when the quantity of thermal storage is greater than the threshold value, and for obtaining addition correction data by adding the correction quantity to the input data when the quantity of thermal storage is equal to or less than the threshold value.

* * * * *